US010315068B1

(12) United States Patent
Stearns et al.

(10) Patent No.: US 10,315,068 B1
(45) Date of Patent: Jun. 11, 2019

(54) EXERCISE METHODS AND APPARATUS

(71) Applicants: Kenneth W Stearns, Houston, TX (US); Joseph D Maresh, West Linn, OR (US)

(72) Inventors: Kenneth W Stearns, Houston, TX (US); Joseph D Maresh, West Linn, OR (US)

( * ) Notice: Subject to any disclaimer, the term of this patent is extended or adjusted under 35 U.S.C. 154(b) by 0 days.

(21) Appl. No.: 15/709,446

(22) Filed: Sep. 19, 2017

Related U.S. Application Data

(63) Continuation of application No. 13/308,538, filed on Nov. 30, 2011, now Pat. No. 9,764,187.

(51) Int. Cl.
*A63B 21/00* (2006.01)
*A63B 22/06* (2006.01)
*A63B 21/02* (2006.01)

(52) U.S. Cl.
CPC ..... *A63B 22/0664* (2013.01); *A63B 21/026* (2013.01); *A63B 22/06* (2013.01); *A63B 2022/067* (2013.01)

(58) Field of Classification Search
None
See application file for complete search history.

(56) References Cited

U.S. PATENT DOCUMENTS 4,961,570 A * 10/1990 Chang ..... A63B 22/0056 482/53
5,888,177 A * 3/1999 Lin ..... A63B 22/0664 482/51
5,938,569 A * 8/1999 Lin ..... A63B 22/001 482/147
6,080,086 A * 6/2000 Maresh ..... A63B 22/001 482/51
6,179,752 B1 * 1/2001 Chang ..... A63B 21/0083 482/52
6,206,804 B1 * 3/2001 Maresh ..... A63B 21/068 482/51
6,620,079 B2 * 9/2003 Kuo ..... A63B 22/001 482/51
6,645,125 B1 * 11/2003 Stearns ..... A63B 22/001 482/52
6,672,992 B1 * 1/2004 Lo ..... A63B 22/0015 482/52
7,041,036 B1 * 5/2006 Kuo ..... A63B 22/001 482/51
7,608,019 B1 * 10/2009 Stearns ..... A63B 22/001 482/52
7,811,207 B2 * 10/2010 Stearns ..... A63B 22/001 482/52
7,981,001 B2 * 7/2011 Stearns ..... A63B 21/0051 434/247
8,449,437 B1 * 5/2013 Maresh ..... A63B 22/001 482/52

(Continued)

*Primary Examiner* — Stephen R Crow
(74) *Attorney, Agent, or Firm* — Nick A. Nichols, Jr.

(57) ABSTRACT

A variable stride exercise apparatus may provide a novel linkage assembly and corresponding exercise apparatus suitable for linking circular motion to relatively more complex, generally elliptical motion. Left and right cranks are rotatably mounted on a frame. A foot supporting linkage is movably connected between a rocker and the left and right cranks in such a manner that may provide variable paths of motion controlled by a user of the apparatus.

6 Claims, 16 Drawing Sheets

(56) References Cited

U.S. PATENT DOCUMENTS

| | | | | |
|---|---|---|---|---|
| 8,852,059 | B1 * | 10/2014 | Stearns | A63B 22/001 482/52 |
| 9,339,685 | B1 * | 5/2016 | Maresh | A63B 22/04 |
| 2002/0119867 | A1 * | 8/2002 | Stearns | A63B 22/0007 482/52 |
| 2004/0214693 | A1 * | 10/2004 | Piaget | A63B 22/0056 482/52 |
| 2007/0298935 | A1 * | 12/2007 | Badarneh | A63B 22/001 482/52 |
| 2008/0261778 | A1 * | 10/2008 | Chuang | A63B 22/001 482/52 |
| 2010/0248899 | A1 * | 9/2010 | Bedell | A63B 22/001 482/4 |
| 2010/0295263 | A1 * | 11/2010 | Teal | B62K 3/002 280/221 |
| 2014/0221166 | A1 * | 8/2014 | Huang | A63B 22/001 482/52 |

* cited by examiner

EXERCISE METHODS AND APPARATUS

CROSS-REFERENCE TO RELATED APPLICATION

This application is a continuation of U.S. Non-Provisional application Ser. No. 13/308,538, filed Nov. 30, 2011, which claims the benefit of U.S. Provisional Application Ser. No. 61/458,693, filed Nov. 30, 2010, which applications are herein incorporated by reference in their entirety.

BACKGROUND OF THE INVENTION

The present invention relates to fitness machines, and in particular to fitness machines which constrain the user's foot and/or arm to travel along a variable or fixed foot path.

Exercise equipment has been designed to facilitate a variety of exercise motions (including treadmills for walking or running in place; stepper machines for climbing in place; bicycle machines for pedaling in place; and other machines for skating and/or striding in place). Yet another type of exercise equipment has been designed to facilitate relatively more complicated exercise motions and/or to better simulate real life activity. Such equipment converts a relatively simple motion, such as circular, into a relatively more complex motion, such as elliptical. Despite various advances in the elliptical exercise category, there remains room for improvement.

SUMMARY OF THE INVENTION

A variable stride exercise apparatus may provide a novel linkage assembly and corresponding exercise apparatus suitable for linking circular motion to relatively more complex, generally elliptical motion. The apparatus may include a frame designed to rest upon a flat surface. Rocker links may be rotatably mounted on respective sides of the frame in spaced relationship with crank disks rotatably mounted on respective sides of the frame. Foot supporting linkages may be movably connected between the rocker links and respective crank disks in such a manner that may provide variable paths of motion controlled by a user of the apparatus.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Figure 1:
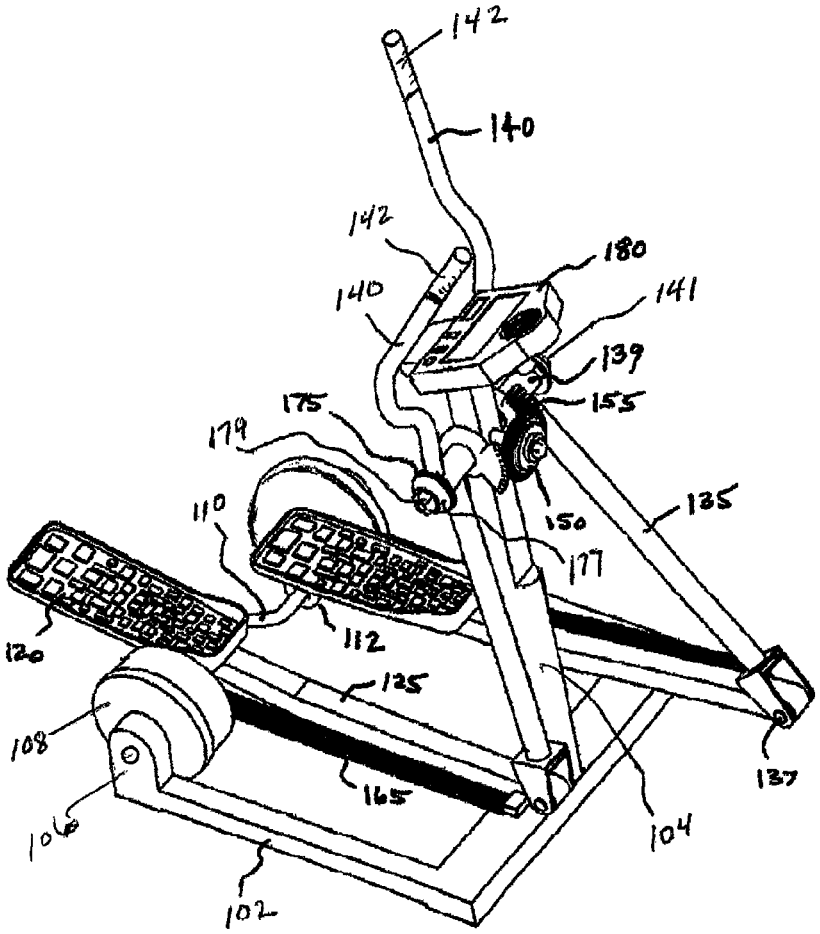
FIG. 1 is a perspective view of a first embodiment of an exercise apparatus.

Elliptical motion exercise apparatus may link rotation of left and right cranks to generally elliptical motion of respective left and right foot supports. The term "elliptical motion" is intended in a broad sense to describe a closed path of motion having a relatively longer major axis and a relatively shorter minor axis. In general, elliptical motion exercise apparatus may be said to use displacement of the cranks to move the foot supports in a direction coincidental with one axis of the elliptical path, and displacement of crank driven members to move the foot supports in a direction coincidental with the other axis. A general characteristic of such exercise apparatus is that the crank diameter determines the length of one axis, but does not determine the length of the other axis. As a result of this feature, a person's feet may pass through a space between the cranks while nonetheless traveling through a generally elliptical path having a desirable aspect ratio, and the apparatus that embody this technology may be made relatively more compact, as well. The embodiments shown and/or described herein are generally symmetrical about a vertical plane extending lengthwise through a floor-engaging base (perpendicular to the transverse ends thereof). In general, the "right-hand" components are one hundred and eighty degrees out of phase relative to the "left-hand" components. However, like reference numerals are used to designate both the "right-hand" and "left-hand" parts, and when reference is made to one or more parts on only one side of an apparatus, it is to be understood that corresponding part(s) are disposed on the opposite side of the apparatus. Also, to the extent that reference is made to forward or rearward portions of an apparatus, it is to be understood that a person can typically exercise on such apparatus while facing in either direction relative to the linkage assembly.

Referring first to FIG. 1, a first embodiment of an exercise apparatus is generally identified by the reference numeral 100. The apparatus 100 includes a frame 102 that is designed to rest upon a floor surface. The frame 102 includes a stanchion 104 that extends upward from a forward end of the frame 102 and rearward stanchions 106 that extend upward proximate an opposite, rearward end of the frame 102.

Left and right crank disks 108 are rotatably mounted on respective sides of the frame 102 at respective stanchions 106 proximate the rear end of the frame 102. A crank 110 is interconnected between the crank disks 108. Left and right rollers 112 are rotatably mounted on the crank 110 for orbital movement about the crank disks 108 axis. Both crank disks 108 are shown in the form of disks, but crank arms may be used in the alternative. An advantage of using a crank disk is that it may be more readily connected to any of various known inertia altering devices, including, for example, a motor, a "stepped up" flywheel, an adjustable braking mechanism, or various combinations thereof.

Left and right rocker links 135 are pivotally mounted on respective sides of the stanchion 104. Each rocker link 135 extends generally downward from a rocker hub 139 that is pivotally connected to a transverse rocker shaft 141 fixed proximate the upper end of the stanchion 104. Left and right handle bars 140 are pivotally mounted on respective sides of the stanchion 104. Each handle bar 140 is rigidly connected to respective rocker hubs 139 and extends generally upward from the rocker hub 139. The upper end of each handle bar 140 includes a hand grip 142.

Left and right longitudinal foot members 125 are pivotally connected to a lower distal end of a respective rocker link 135 at a connection point 137. A rear portion of each foot member 125 includes an underlying race region which is in contact with a respective roller 112 as the crank disks 108 rotate. A foot platform 120 is rigidly connected to each foot member 125.

A center bevel gear 150 is rotatably connected to a shaft 152 fixedly secured proximate the upper end of the stanchion 104. The bevel gear 150 engages with respective right and left rocker bevel gears 155 rigidly connected to respective rocker hubs 139 interconnecting the rocker links 135 to move in dependent fashion in opposite directions relative to one another.

On each side of the frame 102, a rearward distal end of an extension spring 165 is connected to a bearing rotatably mounted on the crank 110 concentric with the roller 112, and a forward distal end of the extension spring 165 is connected proximate the forward end of foot member 125. Alternatively, the forward distal end of the extension spring 165 may be connected at a point along the rocker link 135 between the rocker hub 139 and the lower distal end of the rocker link 135. Adjustable friction disks 175 may be mounted about the transverse rocker shaft 141 proximate the distal ends thereof. The friction disks 175 may be mounted between the rocker hubs 139 and a cover 177 in facing contact with the friction disks 175. A knob 179 threadably mounted on each distal end of the rocker shaft 141 may be adjusted to introduce resistance to the pivotal motion of the rocker links 135, as desired.

Each extension spring 165 operates under tension throughout the stride length as the crank 110 rotates. During use, the extension spring 165 aids in rotating the crank 110 in the direction of the force applied by the user on the foot platform 120. For example, in the absence of the extension spring 165 and assuming that the crank 110 is rotating in a clockwise direction, as the crank 110 approaches the 12 o'clock or vertical position, a forward/downward force applied to the foot platform 120 may cause the crank 110 to stall or change to a counter clockwise rotation. The tension force applied by the extension spring 165 forces the crank 110 to continue its clockwise rotation.

Figure 2:
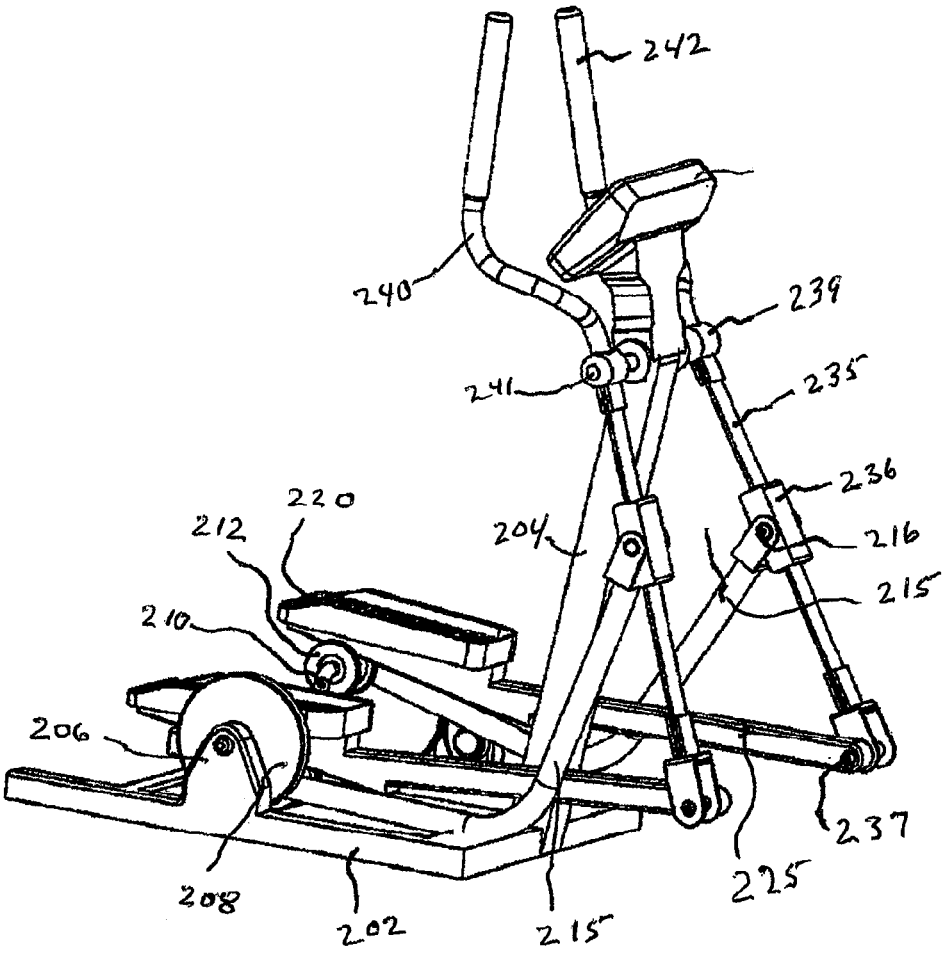
FIG. 2 is a perspective view of a second embodiment of an exercise apparatus.

Directing attention now to FIG. 2, a second embodiment of an exercise apparatus is generally identified by the reference numeral 200. The apparatus 200 generally includes a frame 202 and a linkage assembly movably mounted on the frame 200. Generally, the linkage assembly encourages a force receiving link 225 to travel through an elliptical path of motion having a variable configuration controlled by the user.

The frame 202 includes a stanchion 204 that extends upward from a forward end of the frame 202, and rearward stanchions 206 that extend upward proximate an opposite, rearward end of the frame 202. On each side of the apparatus 200, the linkage assembly generally includes a rocker link 235, a force receiving link 225, a drawbar link 215, a crank 210 and a roller 212 rotatably mounted on the crank 210. Crank disks 208 are rotatably mounted on the frame 202 at respective rearward stanchions 206. The crank 210 may be interconnected between the crank disks 208 by means known in the art.

A rocker link 235 is pivotally mounted on respective sides of the stanchion 204. Each rocker link 235 may comprise a leaf spring that extends generally downward from a rocker hub 239 that is pivotally connected to a transverse rocker shaft 241 fixed proximate the upper end of the stanchion 204. Left and right handle bars 240 are pivotally mounted on respective sides of the stanchion 104. Each handle bar 240 is rigidly connected to a respective rocker hub 239 and extends generally upward from the rocker hub 239. The upper end of each handle bar 240 includes a hand grip 242.

On each side of the apparatus 200, a rearward distal end of the drawbar link 215 is rotatably connected to the crank 210, and a forward distal end of the drawbar link 215 is pivotally connected to a slide bracket 236 at a connection point 216. The bracket 236 may be a clamp or the like that is movably mounted on the rocker link 235.

Referring still to FIG. 2, a forward distal end of the force receiving link 225 is pivotally connected to a lower distal end of the rocker link 235 at connection point 237, and a rearward portion of the force receiving link 225 is in rolling contact with the crank roller 212. During use, the foot path and/or arm path configuration is a function of the force applied by the user to lengthen or shorten the foot path and/or arm path. In the configuration shown in FIG. 2, a sufficient force to overcome the bending moment of the leaf spring rocker link 235 applied by the user to the foot platforms 220 in a longitudinal direction deflects the lower portion of the rocker link 235 below the slide bracket 236 in the direction of the applied force, i.e., forward or backward, resulting in a variable stride length. Likewise, the user may alter the arm path by applying a force to the handle bars 240 sufficient to deflect the upper portion of the leaf spring rocker link 235 above the slide bracket 236 in the direction of the force applied to the handle bars 240, i.e., away from or toward the user.

Figure 3A:
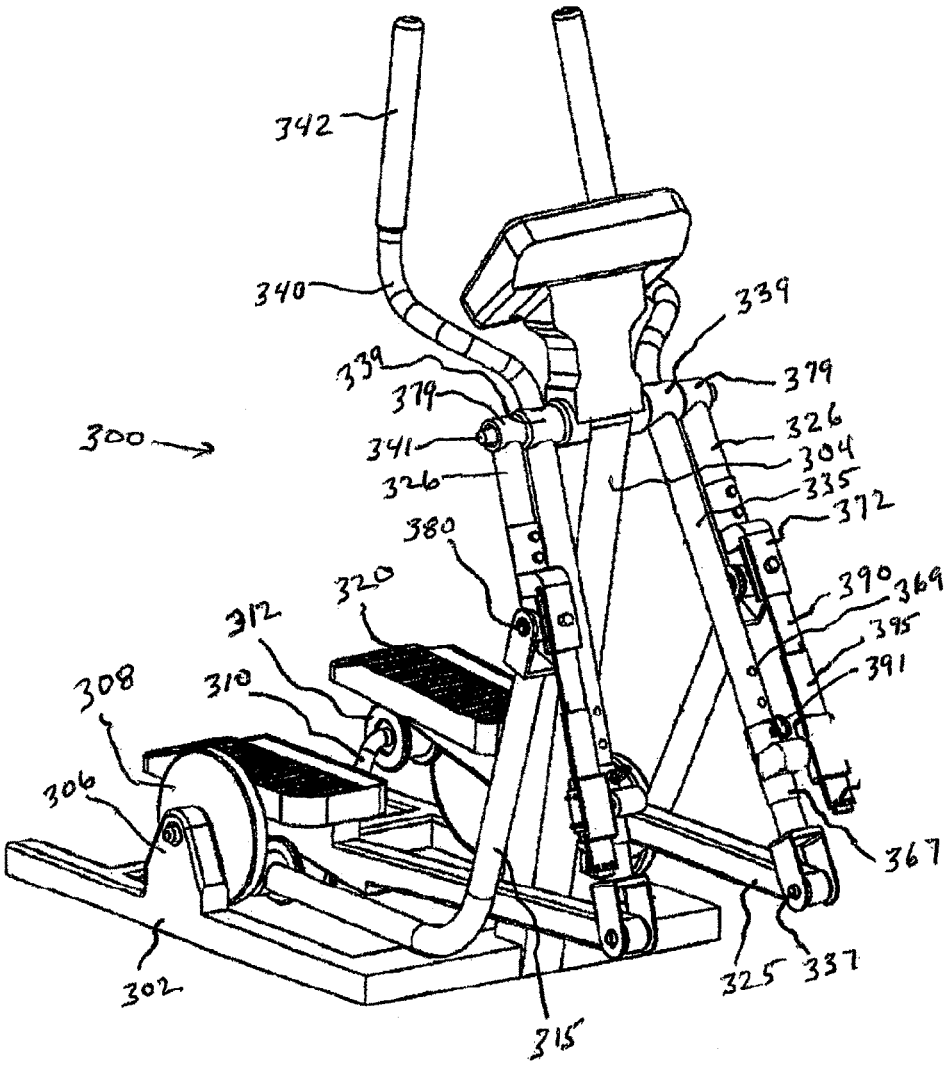
FIGS. 3A and 3B are perspective views of a third embodiment of an exercise apparatus.
Figure 3B:
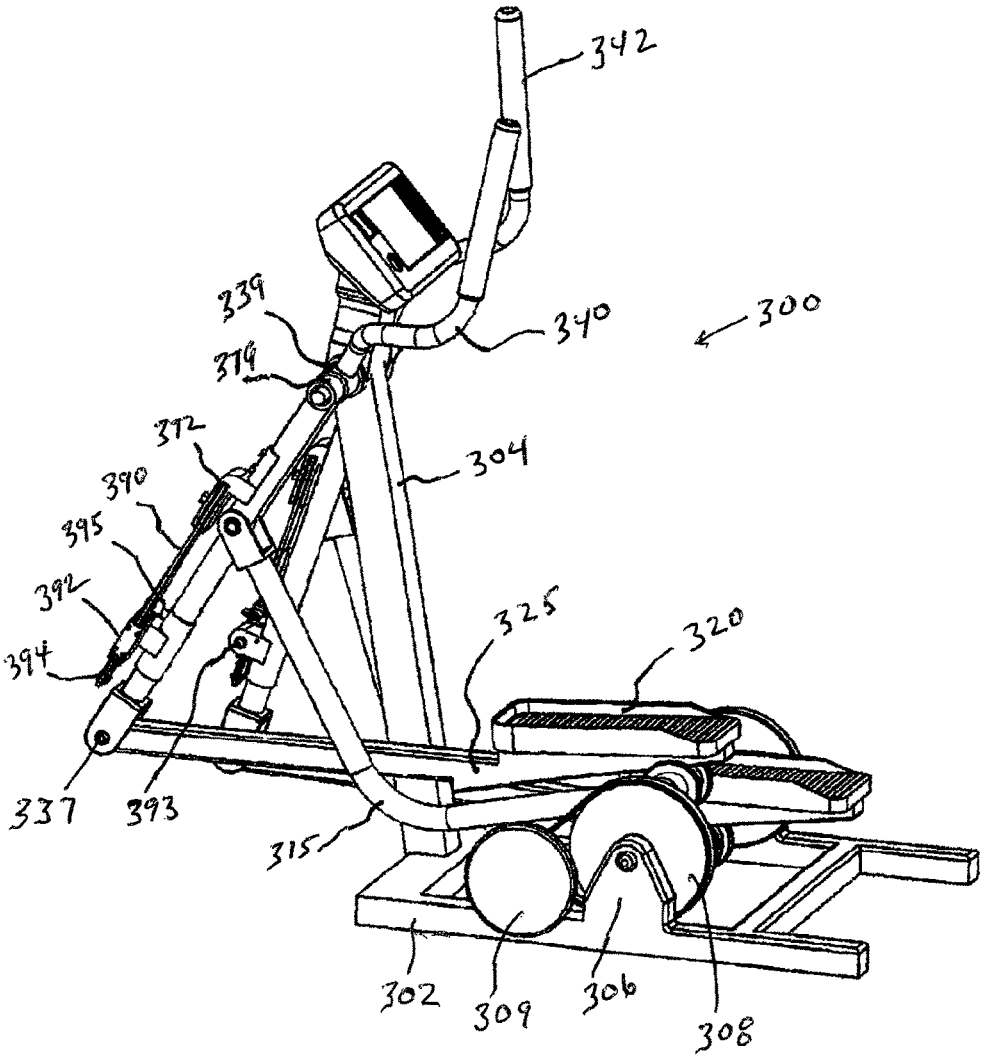
Figure 3C:
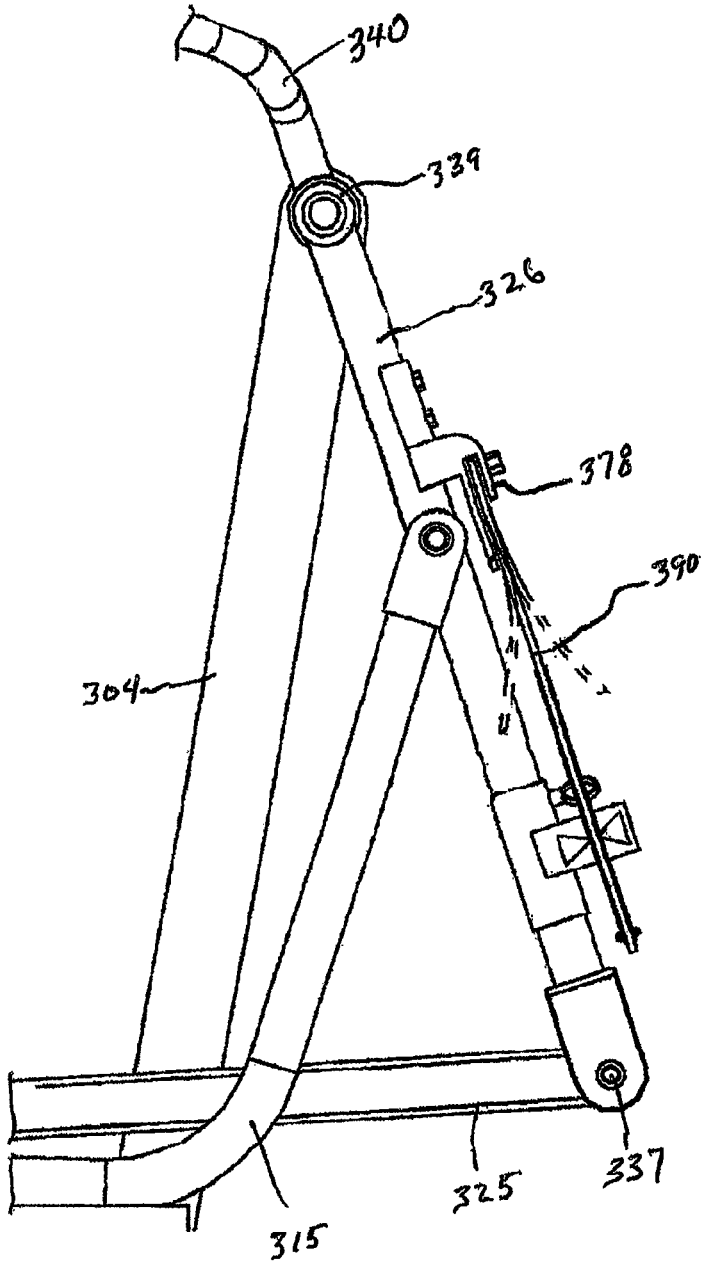
FIG. 3C is a partial side view of the third embodiment of the exercise apparatus shown in FIG. 3A.

Referring now to FIGS. 3A-3C, a third embodiment of an exercise apparatus is generally identified by the reference numeral 300. The apparatus 300 generally includes a frame 302 and a linkage assembly movably mounted on the frame 300. Generally, the linkage assembly encourages a force receiving member 325 to travel through an elliptical path of motion having a variable configuration controlled by the user.

The frame 302 includes a stanchion 304 that extends upward from a forward end of the frame 302, and a rearward stanchion 306 that extends upward proximate an opposite, rearward end on each side of the frame 302. On each side of the apparatus 300, the linkage assembly generally includes a rocker link 335, a force receiving link 325, a drawbar rocker link 326, a drawbar link 315, a crank 310 and a roller 312 rotatably mounted on the crank 310. Crank disks 308 are rotatably mounted on the frame 302 at respective rearward stanchions 306. The crank 310 may be interconnected between the crank disks 308 by means known in the art. The crank 310 may be connected to any of various known inertia altering devices, such as a flywheel 309, to provide resistance to rotation.

A rocker link 335 is pivotally mounted on respective sides of the stanchion 304. Each rocker link 335 extends generally downward from a rocker hub 339 that is pivotally connected to a transverse rocker shaft 341 fixed proximate the upper end of the stanchion 304. Left and right handle bars 340 are pivotally mounted on respective sides of the stanchion 304. Each handle bar 340 is rigidly connected to a respective rocker hub 339 and extends generally upward from the rocker hub 339. The upper end of each handle bar 340 includes a hand grip 342.

A drawbar rocker 326 is rotatably mounted on respective sides of the stanchion 304. Each drawbar rocker 326 extends generally downward from a drawbar rocker hub 379 that is pivotally connected to the transverse rocker shaft 341 concentric with the rocker hub 339. An upper end of a leaf spring 390 is fixedly secured to the drawbar rocker 326 at a lower end thereof by a clamp 372 or the like. The leaf spring 390 extends downwardly from the drawbar rocker 326 A slide clamp 392 slidably engages the leaf spring 390 proximate the lower end thereof. The slide clamp 392 is pivotally connected to a bracket 367 at pivot shaft 393. The location of the bracket 367 may be adjusted along the lower portion of the rocker link 335. The rocker link 335 is provided with spaced holes 369 that may be aligned with a hole 371 in the bracket 367. A removable pin 391 inserted through the aligned holes 369 and 371 secures the bracket 367 to the rocker link 335. The moment arm to which the leaf spring 390 is subjected may be altered by adjustment of the bracket 367, and consequently the slide clamp 392, up or down relative to the rocker link 335 and leaf spring 390, respectively. A change in the moment arm of the leaf spring 390 changes the effect of a user applied force on the stride path and/or arm path.

Generally, the leaf spring 390 may be constructed of metal or nonmetallic materials. For example, the leaf spring 390 may comprise fiberglass strands within an epoxy matrix (alternatively, glass fibers within a nylon or a urethane matrix may be suitable, or the leaf spring may be constructed of wood or metal). For a leaf spring 390 of fiberglass construction (or other abrade-able material such as wood or various plastics), the fiberglass material may be shielded from abrasive contact at the region where relative movement occurs between the slide clamp 392 and the leaf spring 390, by covering the front and rear surfaces of the leaf spring 390 with a thin, low friction sheath 395 disposed between the leaf spring 390 and the slide clamp 392. Bolts 394 or the like secure the sheath 395 to the leaf spring 390. The bolts 394 are located proximate the lower end of the leaf spring 390 so as not to interfere with the relative motion between the leaf spring 390 and the slide clamp 392.

Referring still to FIGS. 3A-3B, a rear distal end of the drawbar link 315 is rotatably connected to the crank 310, and a forward distal end thereof is pivotally connected to the drawbar rocker 326 at a connection point 380. Longitudinal force receiving link 325 is rotatably connected to a lower distal end of the rocker link 335 at connection point 337. A rearward portion of the force receiving link 325 includes a race on an underlying surface thereof in rolling contact with the crank roller 312. A foot platform 320 is rigidly secured proximate the rearward distal end of the force receiving link 325.

Figure 3D:
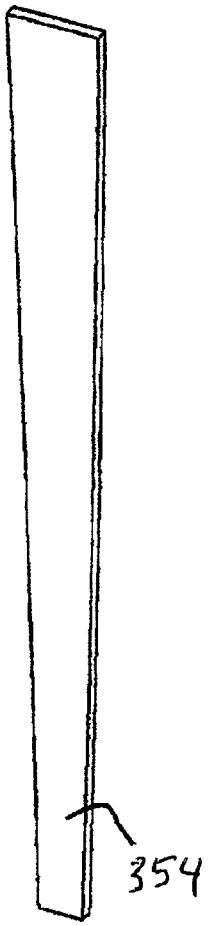
FIGS. 3D and 3E are perspective views of the tapered leaf springs shown in the exercise apparatus of FIG. 3A.
Figure 3E:
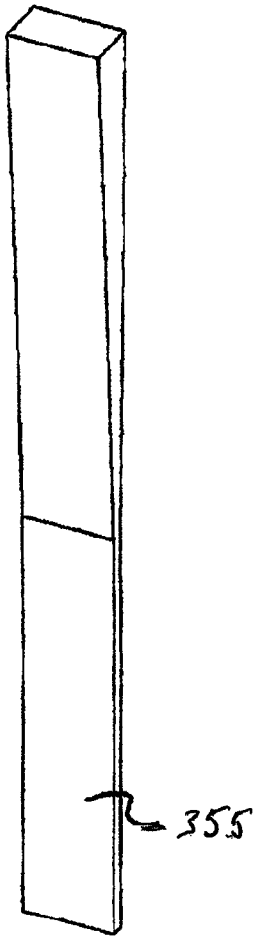

Referring now to FIGS. 3D and 3E, examples of a leaf spring construction are shown. Due to the progressive nature of the force deflection characteristics of the leaf spring, the spring taper may change relative to the neutral axis of the leaf spring. The taper of a leaf spring 354 pertains generally to the changing width from one end of the leaf spring 354 to the other end for any given moment load. The taper of the leaf spring 355 pertains generally to the changing thickness from one end of the leaf spring 355 to the other end for any given moment load.

Figure 4A:
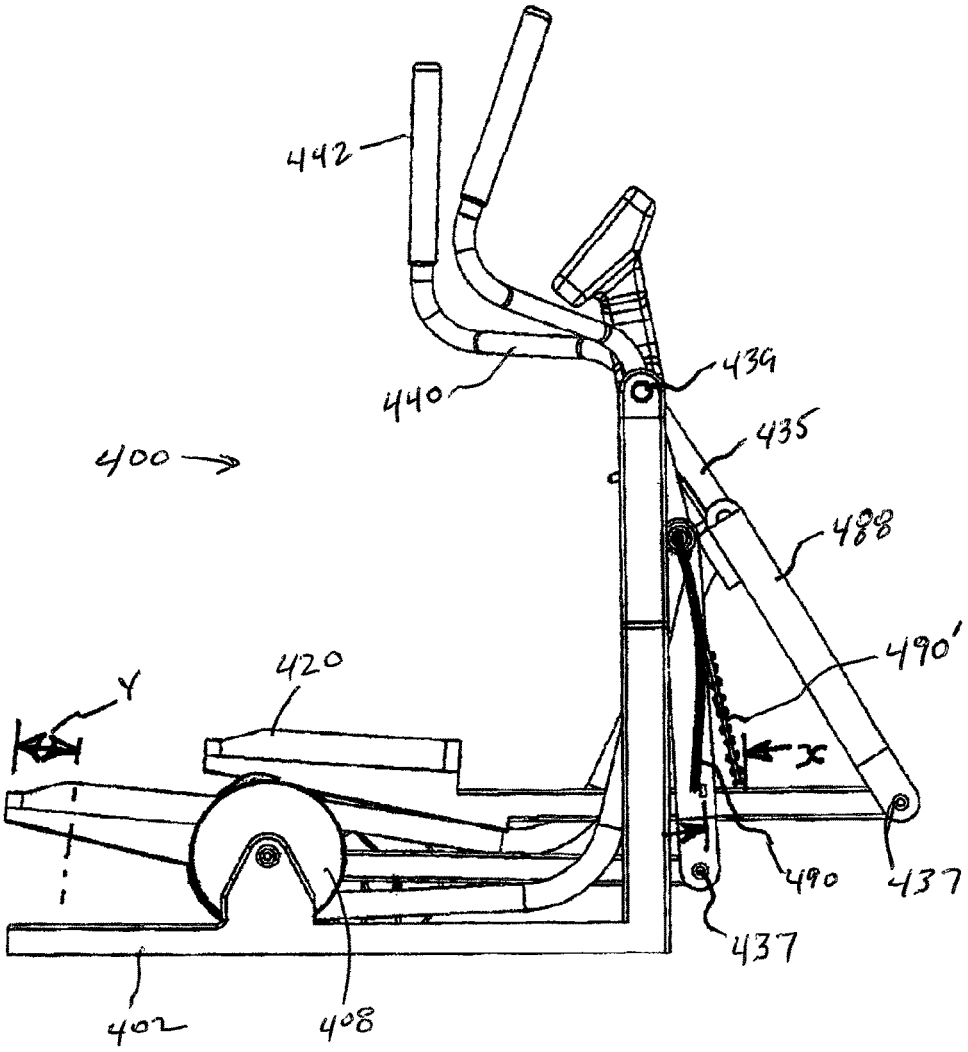
FIG. 4A is a perspective view of a fourth embodiment of an exercise apparatus.
Figure 4B:
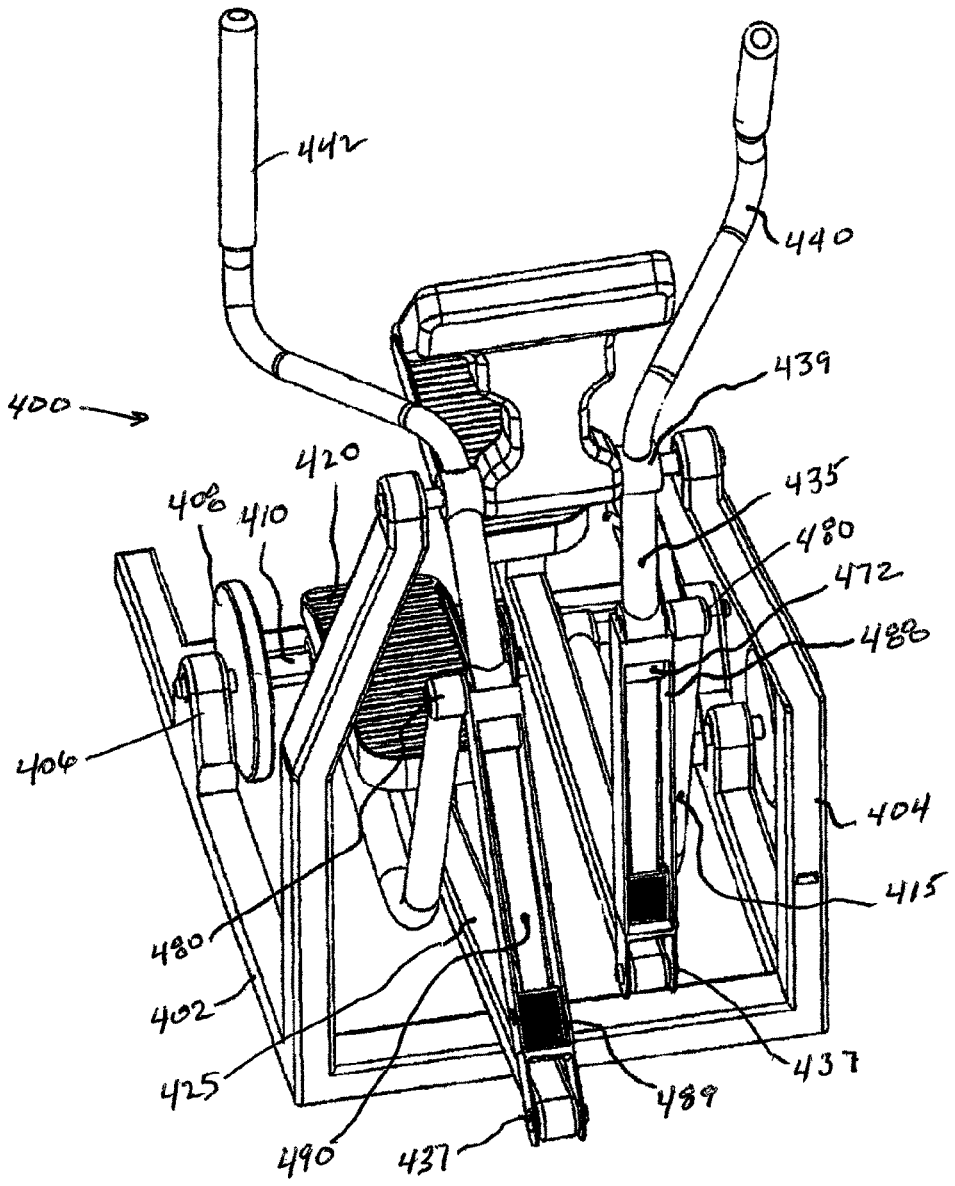
FIG. 4B is a side view partially broken away of the exercise apparatus shown in FIG. 4A.
Figure 5A:
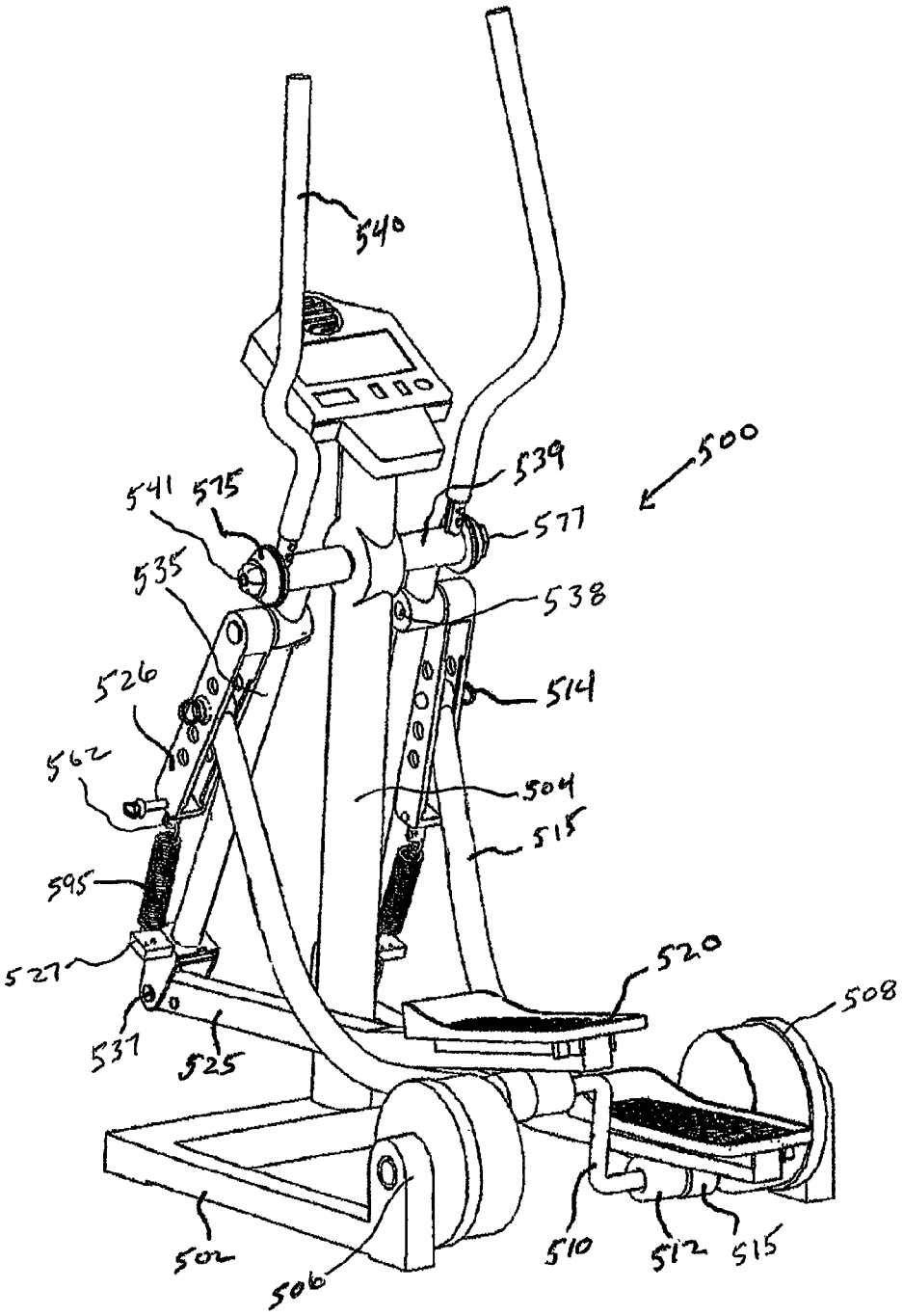
FIG. 5A is a perspective view of a fifth embodiment of an exercise apparatus.
Figure 5B:
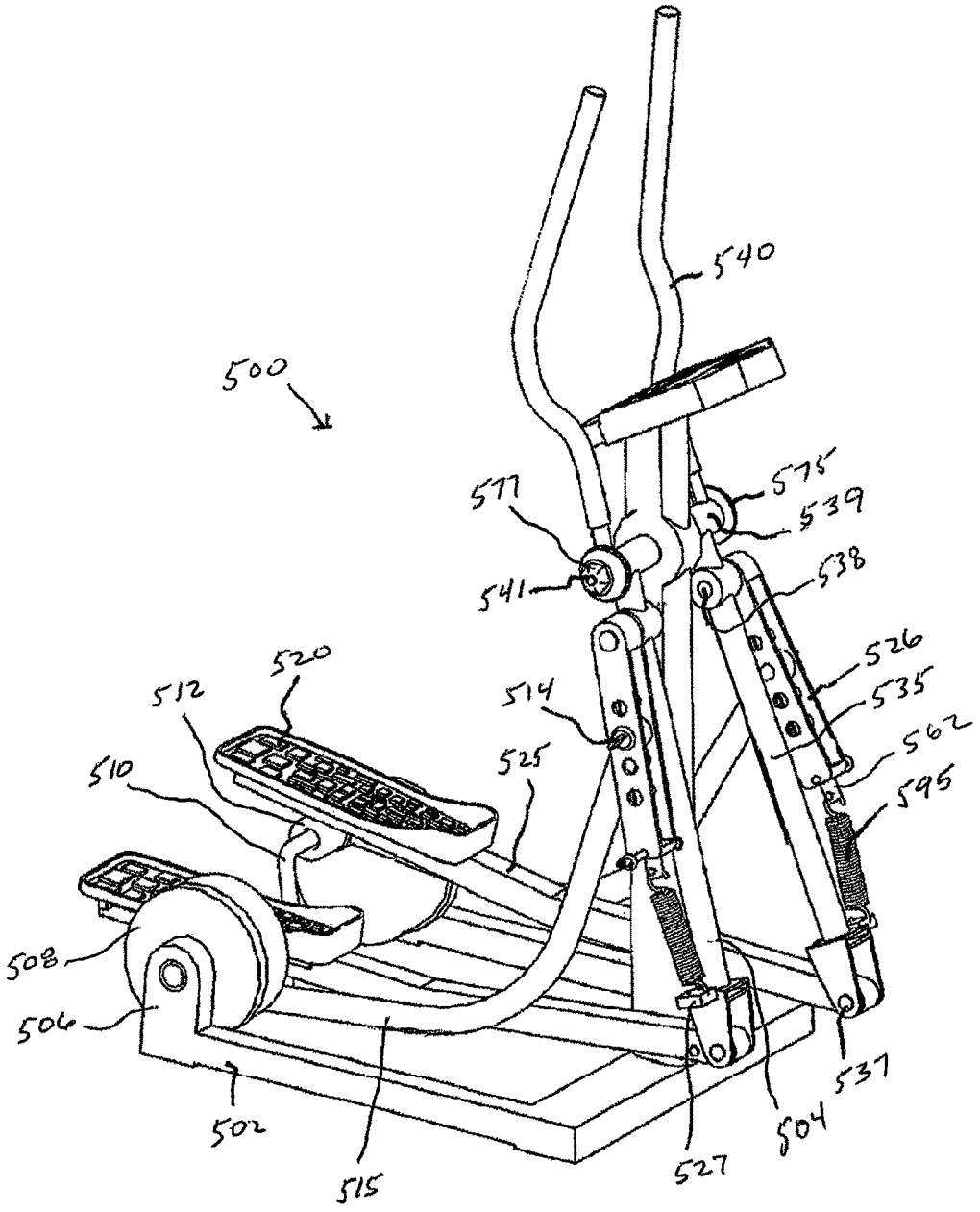
FIG. 5B is a perspective view from the front and side of the exercise apparatus shown in FIG. 5A.
Figure 6A:
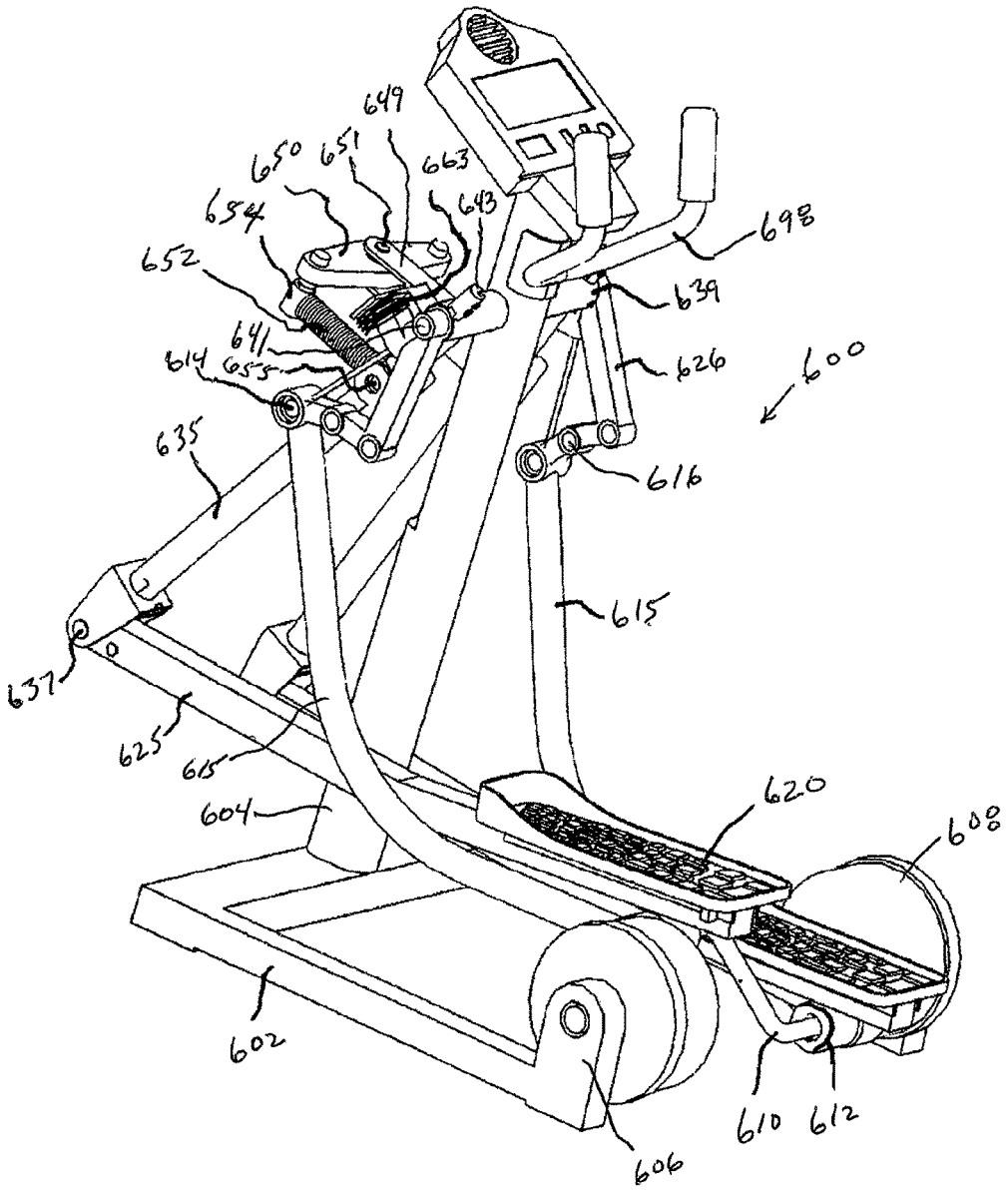
FIG. 6A is a perspective view of a sixth embodiment of an exercise apparatus.
Figure 6B:
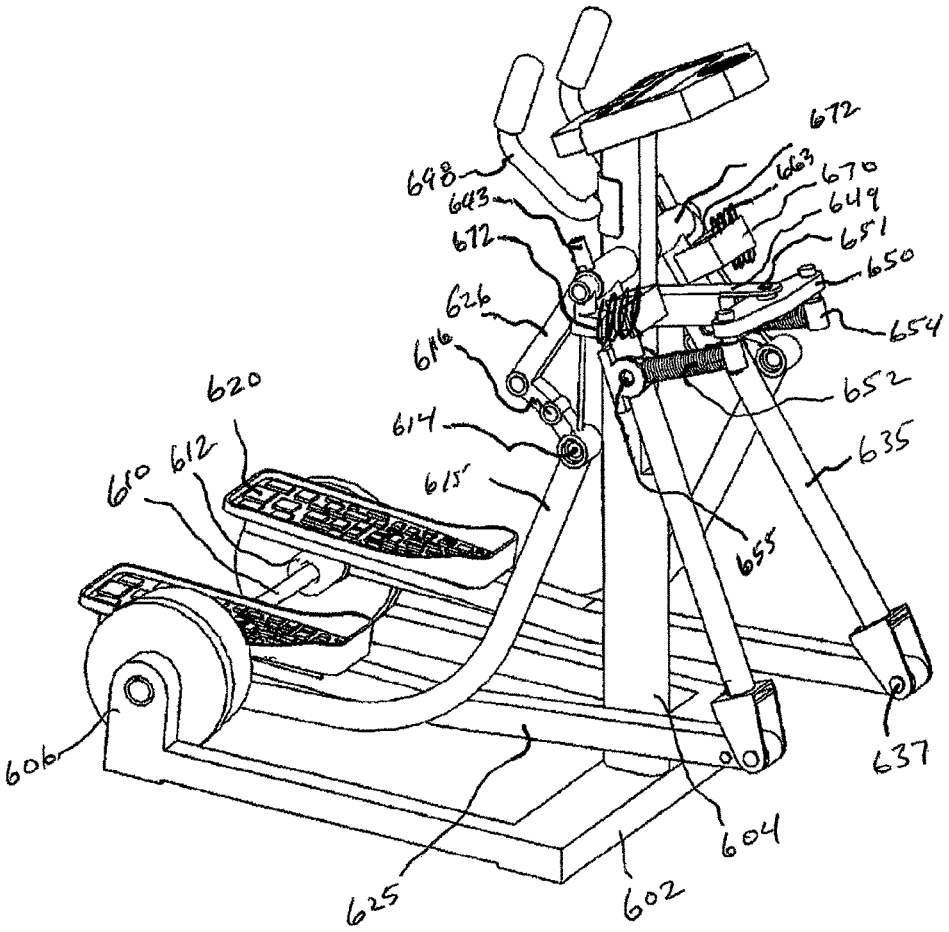
FIG. 6B is a perspective view from the front and side of the exercise apparatus shown in FIG. 6A.
Figure 7A:
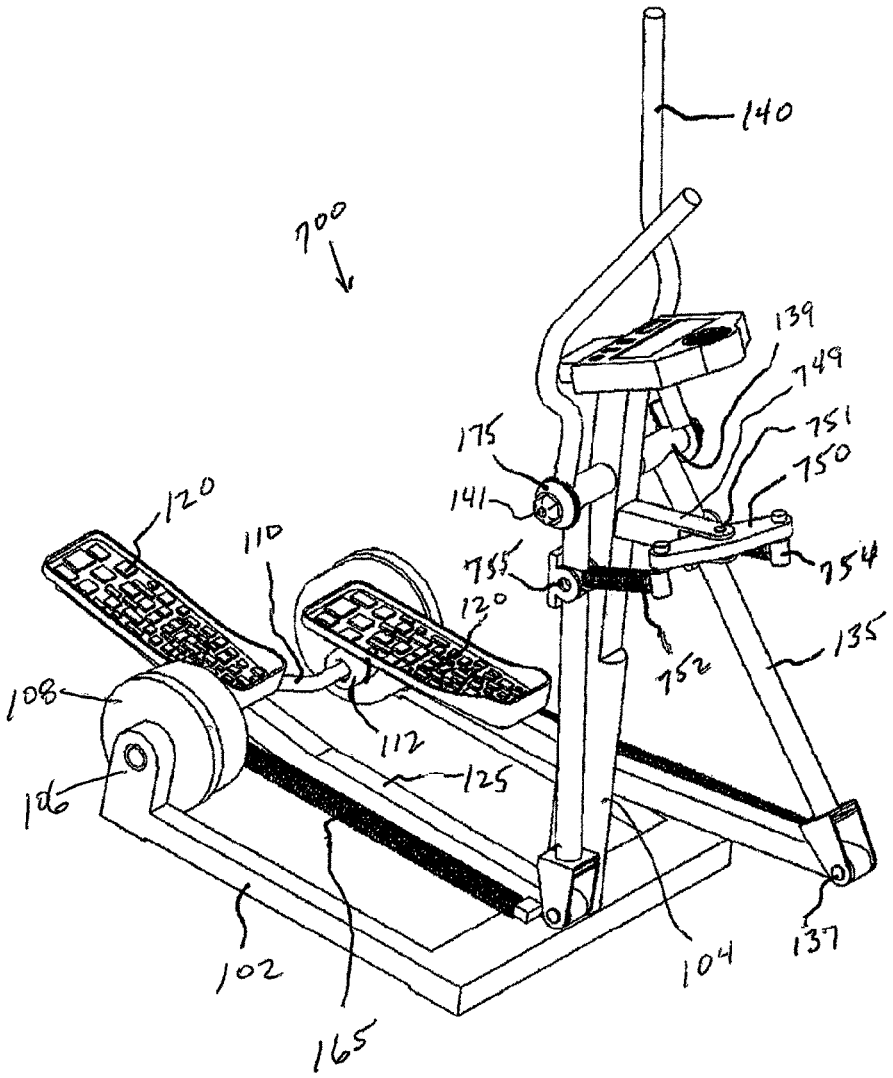
FIG. 7A is a perspective view of a seventh embodiment of an exercise apparatus.
Figure 7B:
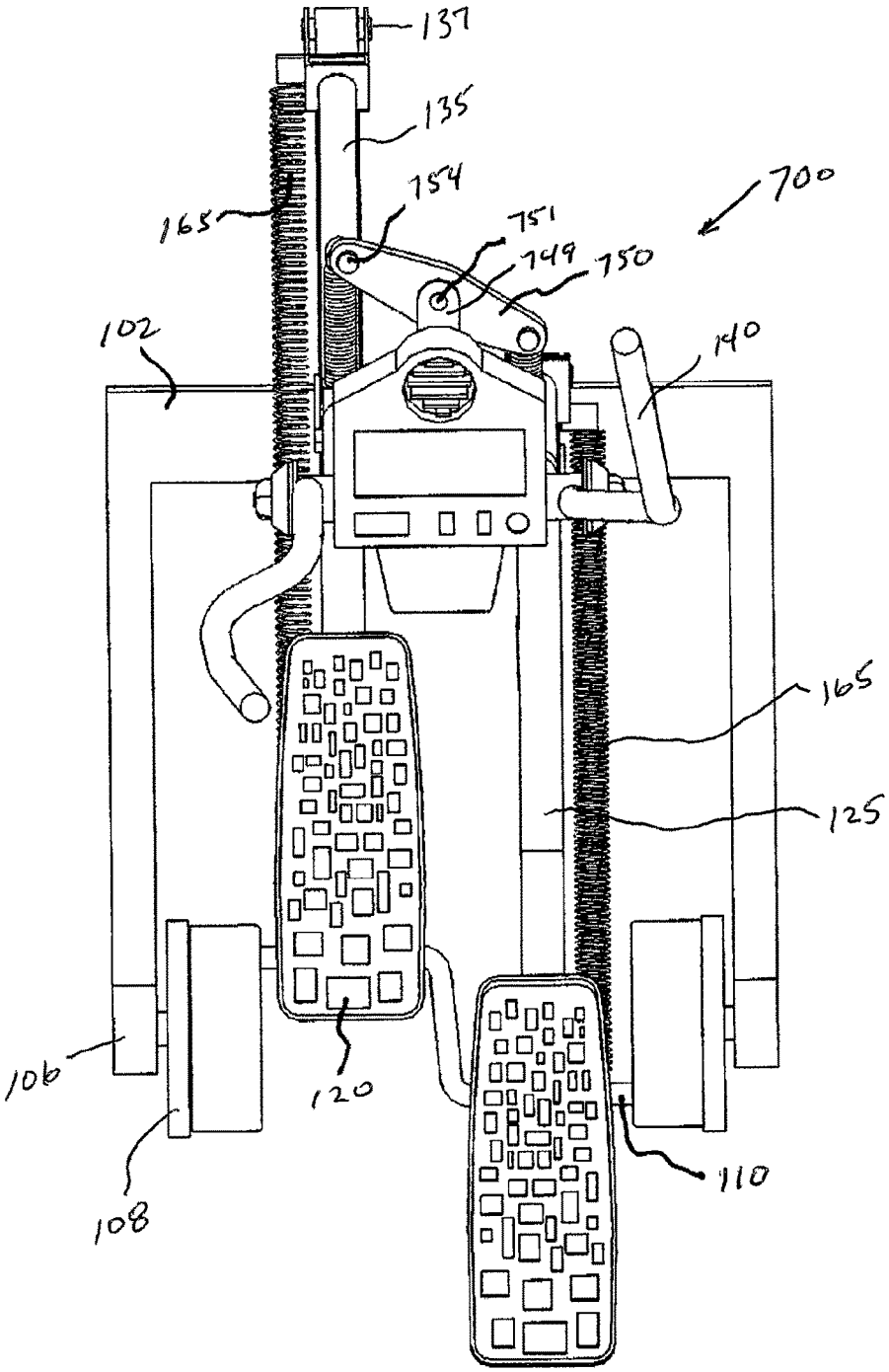
FIG. 7B is a top plan view of the exercise apparatus shown in FIG. 7A.
Figure 8:
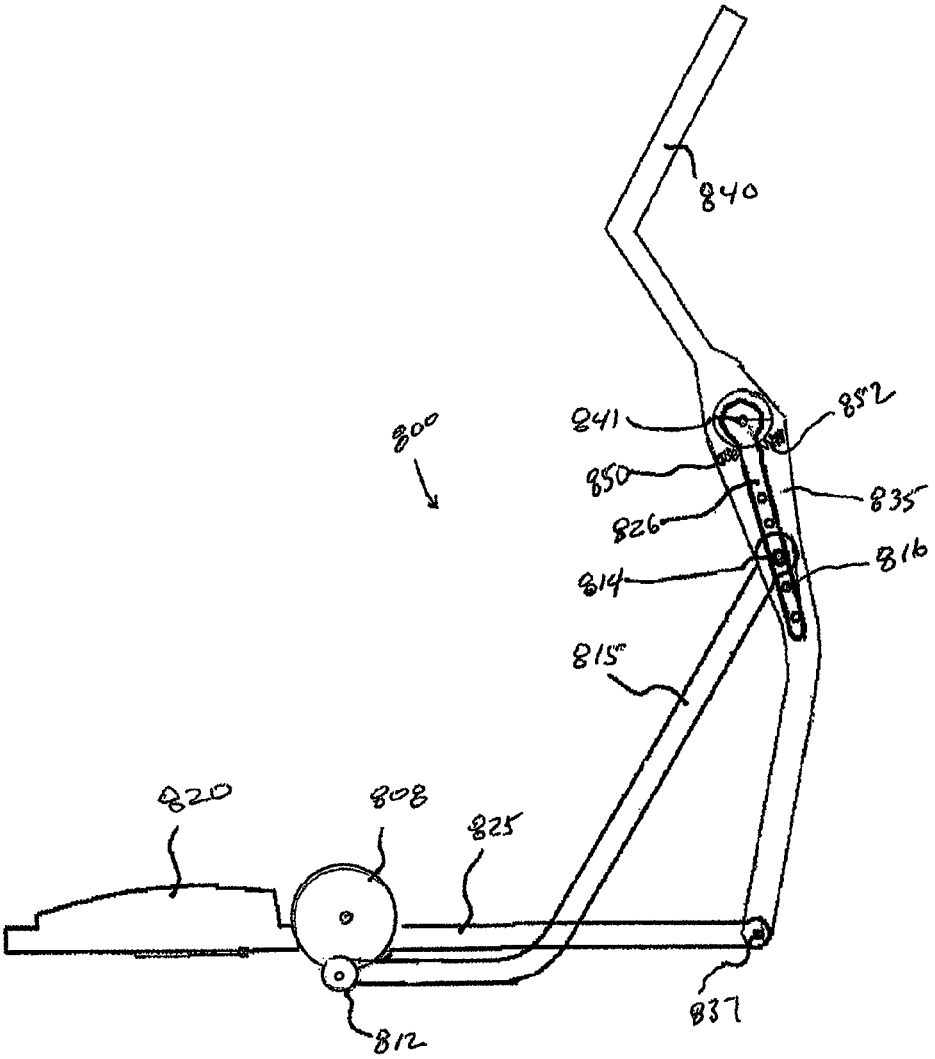
FIG. 8 is a side view of an eighth embodiment of an exercise apparatus.
Figure 9:
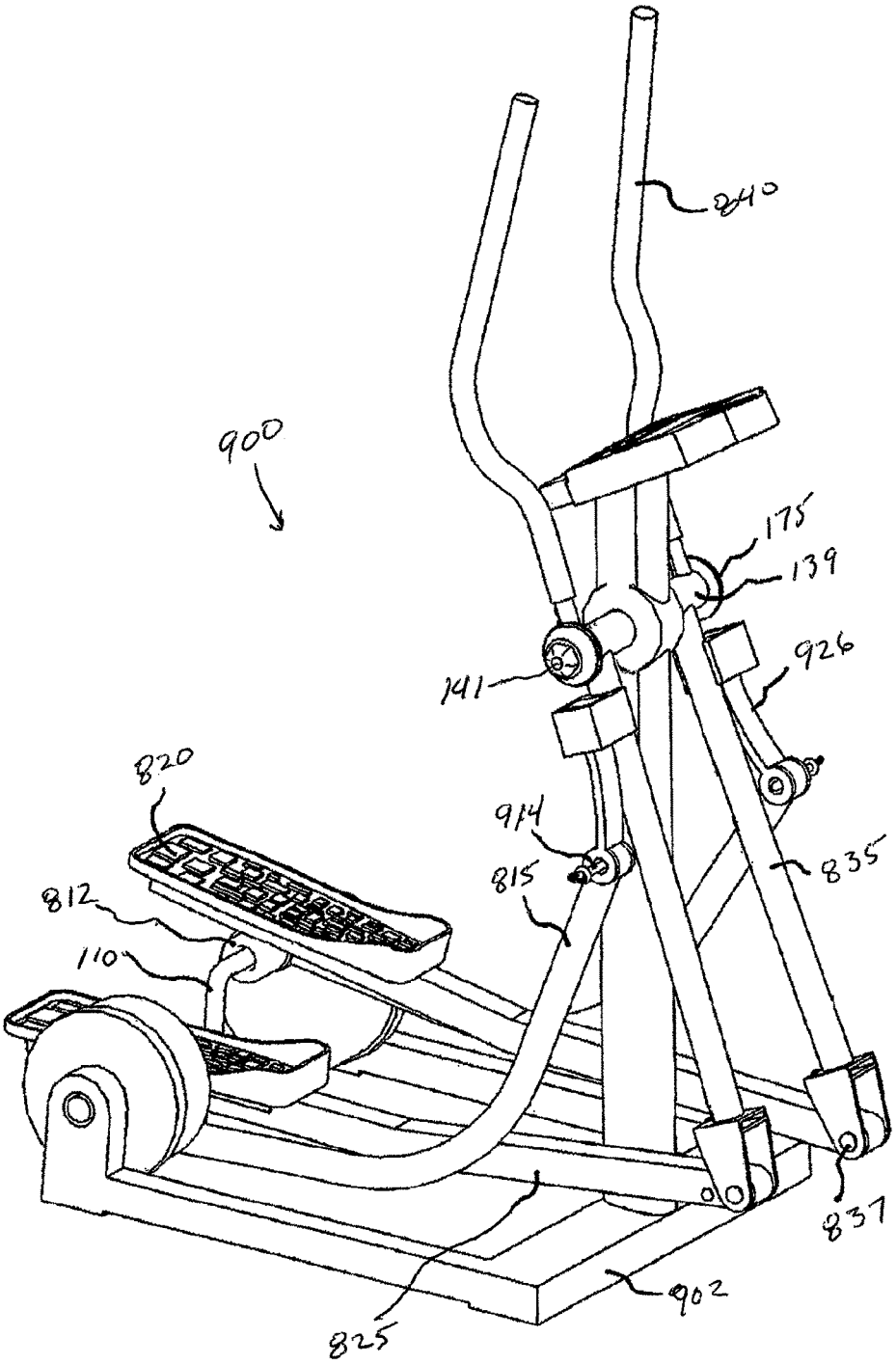
FIG. 9 is a perspective view of a ninth embodiment of an exercise apparatus.

Directing attention now to FIGS. 4A and 4B, a fourth embodiment of an exercise apparatus is generally identified by the reference numeral 400. The apparatus 400 is similar to the apparatus 300 described above with the exception that the arm path of the apparatus 400 is constant and the foot path is variable. The arm path distance is a function of the diameter of the orbital path of the crank 410 about the crank disks axis and the foot path distance is a function of the user applied force against the foot platform 420.

Generally describing the components of the apparatus 400, a handle bar 440 is rigidly connected to a rocker link 435. A leaf spring housing 488 is pivotally connected to the rocker link 435 at connection point 480. The lower distal end of the leaf spring housing 488 is pivotally connected to a forward distal end of a foot support member 425 at connection point 437. An underlying portion of the rearward distal end of the foot support member 425 defines a race that is in rolling contact with a crank roller 412. An upper end of a leaf spring 490 is fixedly secured to the rocker link 435 at a clamp 472 and extends downwardly therefrom. The clamp 472 may be integrally formed with the rocker link 435. A lower end of the leaf spring 490 is in sliding engagement with a slide bracket 489 mounted proximate the lower end distal end of the leaf spring housing 488.

A rear distal end of a drawbar 415 is rotatably connected to a crank 410 and a forward distal end of the drawbar 415 is rotatably connected to the rocker link 435 and by extension to the handle bar 440 at connection point 480. The handle bar 440 is thus rotatably connected to the crank 410 and thereby the arm path distance is a function of the diameter of the orbital path of the crank 410 about the crank disks 408 axis.

Continuing now and referring to FIG. 4B, during use the lower end of the leaf spring 490 may be deflected by a longitudinal distance X as force is applied by the user to the foot platform 420 moving the foot support member 425 rearward and forward and causing the leaf spring housing 488 to pivot about the connection point 480. In the configuration shown in FIG. 4B, the deflection distance X of the leaf spring 490 corresponds to an increased foot stride length Y at the rearward distal end of the foot support member 425. If the user applied force is not sufficient to overcome the bending moment of the leaf spring 490, the leaf spring 490 maintains a substantially straight undeflected orientation, indicated as 490' in FIG. 4B.

While various preferred embodiments of the invention have been shown and described, other and further embodiments of the invention may be devised without departing from the basic scope thereof, and the scope thereof is determined by the claims which follow.

The invention claimed is:

1. A variable motion exercise apparatus, comprising:

a) a frame designed to rest upon a floor surface;

b) a left crank disk and a right crank disk, wherein each said crank disk is mounted on a respective side of said frame and rotatable about a common crank axis, a transverse crank interconnecting said left crank disk and said right crank disk;

c) a left rocker link and a right rocker link, wherein each said rocker link is mounted on a respective side of said frame and rotatable about a common pivot axis;

d) a left foot support and a right foot support, wherein each said foot support is movably coupled between a respective said rocker link and said crank;

e) a left extension spring and a right extension spring having a respective first end connected proximate opposite distal ends of said crank and a respective second end connected proximate a forward end of a respective said left and right foot support; and f) wherein each said foot support is movably connected between a respective rocker link and said crank in such a manner that a foot supporting portion of each said foot support is constrained to move through a generally elliptical path as a respective said left and right crank disk rotates.

2. The variable motion exercise apparatus of claim 1 wherein each said left and right foot support include a forward end pivotally connected to a respective said left and right rocker link, each said left and right foot support including a rear portion in contact with left and right rollers mounted proximate opposite distal ends of said crank.

3. The variable motion exercise apparatus of claim 1 wherein said second end of each said left and right extension spring connect at a point along a respective said left and right rocker link.

4. The variable motion exercise apparatus of claim 1 wherein each said left and right rocker link extend downward from a respective left and right rocker hub pivotally connected to a transverse rocker shaft defining the common pivot axis of said left and right rocker link.

5. The variable motion exercise apparatus of claim 4 including a center bevel gear rotatably connected to a shaft fixedly secured to said frame, said center bevel gear operatively engaging respective left and right rocker bevel gears rigidly connected to a respective said left and right rocker hub, interconnecting said left and right rocker link to move in dependent fashion in opposite directions relative to one another.

6. The variable motion exercise apparatus of claim 1 including friction disks mounted about a transverse rocker shaft defining the common pivot axis of said left and right rocker link, and further including a knob threadedly mounted on opposite distal ends of said transverse rocker shaft, each said knob being adjustable to introduce resistance to pivotal motion of each said left and right rocker link.

* * * * *